US006722673B1

(12) United States Patent
Hamlin

(10) Patent No.: US 6,722,673 B1
(45) Date of Patent: Apr. 20, 2004

(54) PORTABLE COMPUTER CART WITH ELECTRICAL OUTLETS, TELEPHONE HOOKUPS, AND STORAGE AREA FOR BRIEFCASE

(76) Inventor: H. L. Roy Hamlin, 21213 Palos Verdes Blvd., Torrance, CA (US) 90503

( * ) Notice: Subject to any disclaimer, the term of this patent is extended or adjusted under 35 U.S.C. 154(b) by 0 days.

(21) Appl. No.: 10/304,024

(22) Filed: Nov. 25, 2002

(51) Int. Cl.[7] ..... B62B 7/12

(52) U.S. Cl. ..... 280/47.35; 108/50.01; 312/223.2

(58) Field of Search ..... 280/30, 47.31, 280/47.33, 47.35, 47.41, 79.11, 79.2, 79.3, 79.6, 79.7, 47.19; 108/7, 10, 147, 50.01; 312/223.3, 208, 194; 248/242, 243, 917

(56) References Cited

U.S. PATENT DOCUMENTS 4,640,199 A * 2/1987 Zigman ..... 312/223.3
5,287,815 A * 2/1994 Gross ..... 108/50.14
5,450,800 A * 9/1995 Leonard ..... 108/7
5,845,587 A * 12/1998 Ditonto ..... 108/50.01
5,913,582 A * 6/1999 Coonan ..... 312/223.3
6,112,989 A * 9/2000 Sheldon ..... 235/384
6,312,069 B1 * 11/2001 Weng ..... 108/147
6,315,308 B1 * 11/2001 Konopka ..... 280/47.35
6,493,217 B1 * 12/2002 Jenkins, Jr. ..... 312/223.2

* cited by examiner

*Primary Examiner*—Brian L. Johnson
*Assistant Examiner*—Hau Phan
(74) *Attorney, Agent, or Firm*—Goldstein Law Offices, P.C.

(57) ABSTRACT

A portable computer cart with a plurality of electrical outlets, telephone hookups, and a storage area for a briefcase. The base of the cart rests upon four selectively removable casters. The cart further has three side panels extending vertically upward from the base and a horizontal table portion resting upon the top of the side panels. The table portion has a metal pole extending vertically upward for supporting a horizontal pedestal. The cart has an electrical panel on one of the side panels having a plurality of electrical outlets and telephone hookups. In use, a briefcase or other carrying case is placed upon the base where its contents are easily accessible. Components of laptop and personal computers may be placed upon the pedestal, the table portion, or the base. Electrical outlets and telephone hookups needed to power, recharge, or connect the computers to the Internet are all within easy reach upon the side panel.

3 Claims, 2 Drawing Sheets

PORTABLE COMPUTER CART WITH ELECTRICAL OUTLETS, TELEPHONE HOOKUPS, AND STORAGE AREA FOR BRIEFCASE

BACKGROUND OF THE INVENTION

1. Field of the Invention

The invention relates generally to a portable computer cart and in particular, to a portable computer cart with electrical outlets, telephone hookups, and a storage area for a briefcase or other carrying case.

2. Description of the Related Art

U.S. Pat. No. 6,218,796 to Kozlowski appears to show a cart for storing rechargeable devices such as notebook computers. U.S. Pat. No. 6,008,621 to Madison appears to show a portable computer charging system and storage cart. U.S. Pat. No. 5,697,686 to Miller appears to show a computer cart suited to hold a laptop for use by a seated operator.

None of these carts appear to disclose a similar construction for a portable computer cart having a plurality of electrical outlets, a plurality of telephone hookups, and an easily accessible area for placement of a briefcase or other objects.

While these units may be suitable for the particular purpose employed, or for general use, they would not be as suitable for the purposes of the present invention as disclosed hereafter.

SUMMARY OF THE INVENTION

It is an object of the invention to produce a cart which is portable and upon which a computer may be positioned. Accordingly, the cart has a horizontal pedestal and a horizontal table portion upon which a computer may be positioned, and the cart further has four casters, thereby allowing the cart to be wheeled to various locations.

It is another object of the invention to produce a cart which provides at a single location all of the electrical connections that may be required for connecting a computer to the internet. Accordingly, the cart has an electrical panel having electrical outlets for powering a computer, and telephone hookups for connecting a computer modem to a phone line, thereby allowing access to the Internet.

It is still another object of the invention to produce a cart which has an area upon which a briefcase or other carrying case may be conveniently placed. Accordingly, the cart has a base upon which a briefcase or other carrying case may be positioned, thereby allowing a user to easily access the contents therein.

It is still yet another object of the invention to produce a cart which may be used to recharge the batteries of a laptop computer or cell phone, or to power a variety of computers or cell phones. Accordingly, the cart is equipped with an electrical panel having a plurality of electrical outlets for supplying alternating current to a great variety of electrical devices.

It is an additional object of the invention to produce a cart which may be immobilized at a particular location. Accordingly, the cart has four selectively removable casters, thereby allowing a user to immobilize the cart at a particular location.

It is a further object of the invention to produce a cart which is not unduly expensive. Accordingly, the structural components of the cart may be made from inexpensive plastic, and the cost of its electrical components is not prohibitive.

The invention is a portable computer cart with a plurality of electrical outlets, telephone hookups, and a storage area for a briefcase. The base of the cart rests upon four selectively removable casters. The cart further has three side panels extending vertically upward from the base and a horizontal table portion resting upon the top of the side panels. The table portion has a metal pole extending vertically upward for supporting a horizontal pedestal. The cart has an electrical panel on one of the side panels having a plurality of electrical outlets and telephone hookups. In use, a briefcase or other carrying case is placed upon the base where its contents are easily accessible. Components of laptop and personal computers may be placed upon the pedestal, the table portion, or the base. Electrical outlets and telephone hookups needed to power, recharge, or connect the computers to the Internet are all within easy reach upon the side panel.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
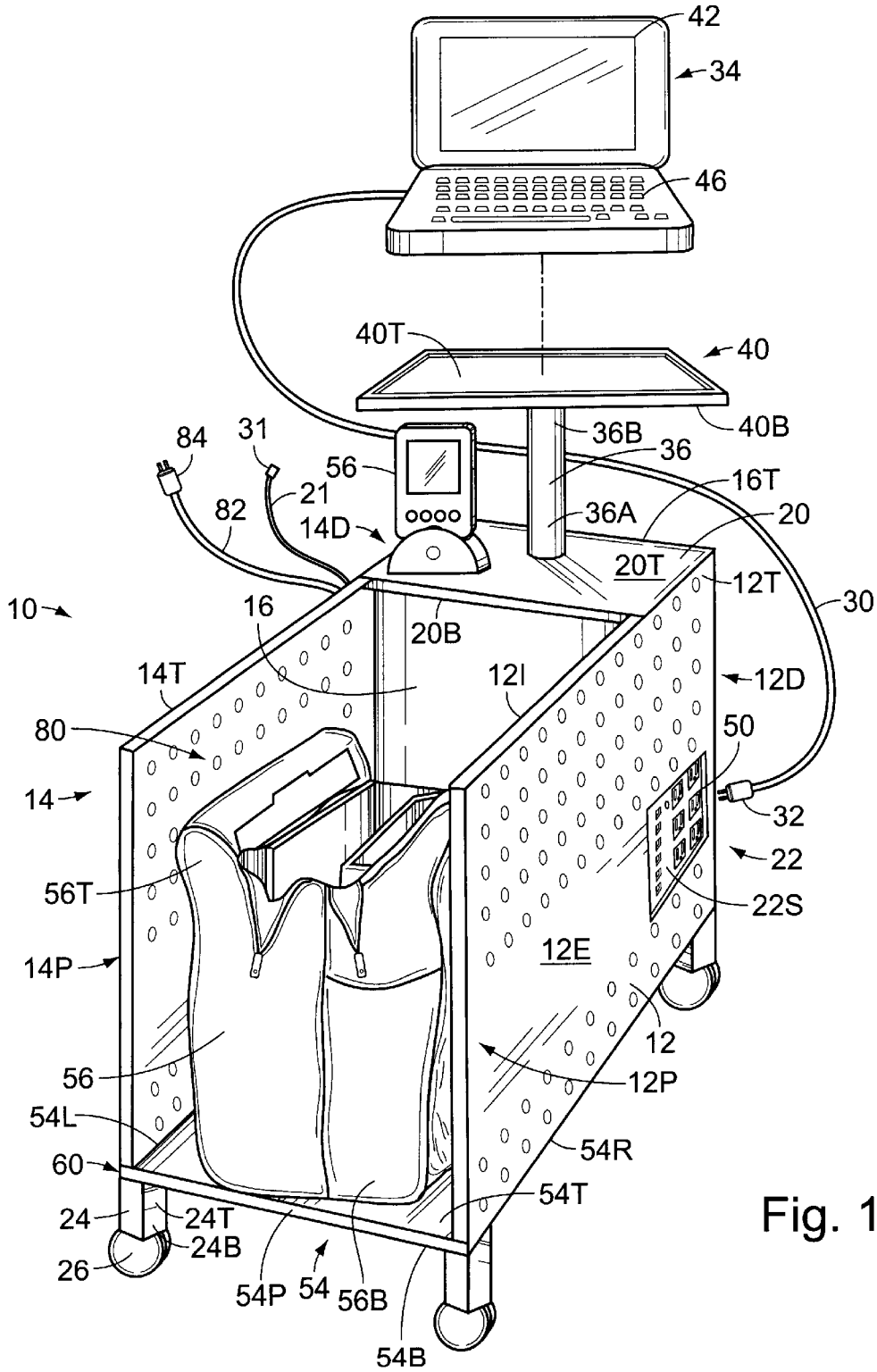
FIG. 1 is a perspective view of the cart wherein a computer is positioned above the pedestal and a briefcase is positioned upon the base.

FIG. 1 illustrates a perspective view of the cart 10. The cart has a rectangular base 54 having a top surface 54T, a bottom surface 54B, and four corners 60. The base 54 also has a first lateral side 54R, a second lateral side 54L, a proximal side 54P and a distal side. The distal side of the base 54 is not visible in FIG. 1. The cart 10 further has three side panels, namely, a first side panel 12 extending vertically upward from the top surface 54T of the base 54 at the first lateral side 54R of the base 54, a second side panel 14 extending vertically upward from the top surface 54T of the base at the second lateral side 54L of the base 54, and a third side panel 16 extending vertically upward from the top surface 54T of the base 54 at the distal side of the base 54. The first side panel 12 has a proximal portion 12P which is located closer to the proximal side 54P of the base 54, and a distal portion 12D which is located closer to the distal side of the base 54. Similarly, the second side panel 14 has a proximal portion 14P which is located closer to the proximal side 54P of the base 54, and a distal portion 14D which is located closer to the distal side of the base 54. Additionally, each side panel has an inside surface which is oriented toward the interior 80 of the cart 10 and an outside surface which is oriented toward the exterior of the cart. In particular, the first side panel 12 has an inside surface 12I which is oriented toward the interior 80 of the cart 10 and an outside surface 12E which is oriented toward the outside of the cart 10. The proximal side 54P of the base 54 does not have a side panel extending vertically upward therefrom, in order that a user may easily place objects such as a briefcase 56 upon the top surface 54T of the base 54 by extending the objects between the proximal portion 12P of the first side panel 12 and the proximal portion 14P of the second side panel 14 toward the distal side of the base. Each of the side panels 12, 14, and 16 further has a top portion, 12T, 14T, and 16T, respectively.

The cart 10 further comprises a horizontal table portion 20 having a top surface 20T and a bottom surface 20B, wherein the bottom surface 20B is supported upon and attached to the top portions 12T, 14T, and 16T. The horizontal table portion 20 rests along the entire top portion 16T of the third side panel 16, but rests only upon the distal portion 12D of the top 12T of the first side panel 12 and the distal portion 14D of the top 14T of the second side panel 14. The horizontal table portion 20 does not rest upon the proximal portion 12P of the first side panel 12 and the proximal portion 14P portion of the second side panel 14. The placement of the horizontal table portion 20 upon only the top 16T of the third side panel 16 and the more distal portions of the first side panel 12 and the second side panel 14 allows a user to easily place or remove objects such as a briefcase 56 upon the top surface 54T of the base 54 by lowering or raising the objects between the top 12T of the proximal portion 12P of the first side panel 12 and the top 14T of the proximal portion 14P of the second side panel 14.

The cart 10 further has a support pole 36, having a first end 36A and a second end 36B, wherein the first end 36A is attached to and extends vertically upward from the top surface 20T of the horizontal table portion 20, and wherein the second end 36B has a horizontal pedestal 40 resting thereupon. In particular, the pedestal 40 has a pedestal bottom surface 40B which rests upon and is attached to the second end 36B of the pole 36. The pedestal 40 also has a pedestal top surface 40T whereupon a computer 34 may be positioned while the cart 10 is being deployed.

The cart 10 has four legs 24, each having a top portion 24T and a bottom portion 24B, wherein the top portion 24T of each leg 24 is attached to the bottom surface 54B of the base 54 at each of the four corners 60 of the base 54. The bottom portion 24B of each leg 24 has a selectively removable caster 26, whereby the cart 10 can be rolled to various positions as desired by the user. Alternatively, the user may remove the casters 26 from the bottom portion 24B of each leg, and thereby immobilize the cart 10.

The distal portion 12D of the first side panel 12 has an electrical panel 22 on its outside surface 12E at a position substantially midway between the top 12T of the first side panel 12 and the base 54. The electrical panel 22 has a plurality of electrical outlets 50 for powering and recharging computers and cell phones, a plurality of telephone hookups 52 for powering telephones and computer modems, and an on/off switch 72 for selectively powering the electrical outlets 50 and the telephone hookups 52. The electrical outlets 50 of the electrical panel 22 are powered by an electrical cord 82 which extends from the rear surface of the electrical panel 22 out through an opening in one of the side panels before terminating in a plug 84 which is inserted into a wall outlet. The electrical cord 82 is plugged into a wall outlet which supplies alternating current when the cart 10 is being deployed. Analogously, the telephone hookups 52 are connected to a telephone line with a phone cable 21 which extends from the rear surface of the electrical panel 22 out through an opening in one of the side panels before terminating in a modular phone jack 31 which selectively is plugged into a wall telephone outlet.

Various devices may be positioned as needed at different locations upon the cart 10. In particular, FIG. 1 illustrates a briefcase 56, having a top surface 56T and a bottom surface 56B, wherein the bottom surface 56B rests upon the top surface 54T of the base 54, and wherein the briefcase 56 is open at its top surface 56T, thereby allowing a user to have easy access to the contents which are held therein. Also shown is a laptop computer 34 having a keyboard 46 and an attached monitor 42, wherein the keyboard 46 is being positioned upon the top surface 40T of the pedestal 40. The computer 34 has an electrical cord 30 which terminates in a plug 32 which is being positioned to extend into an electrical outlet 50. Additionally, a hand-held computer 56 may be situated upon the top surface 20T of the horizontal table portion 20.

Figure 2:
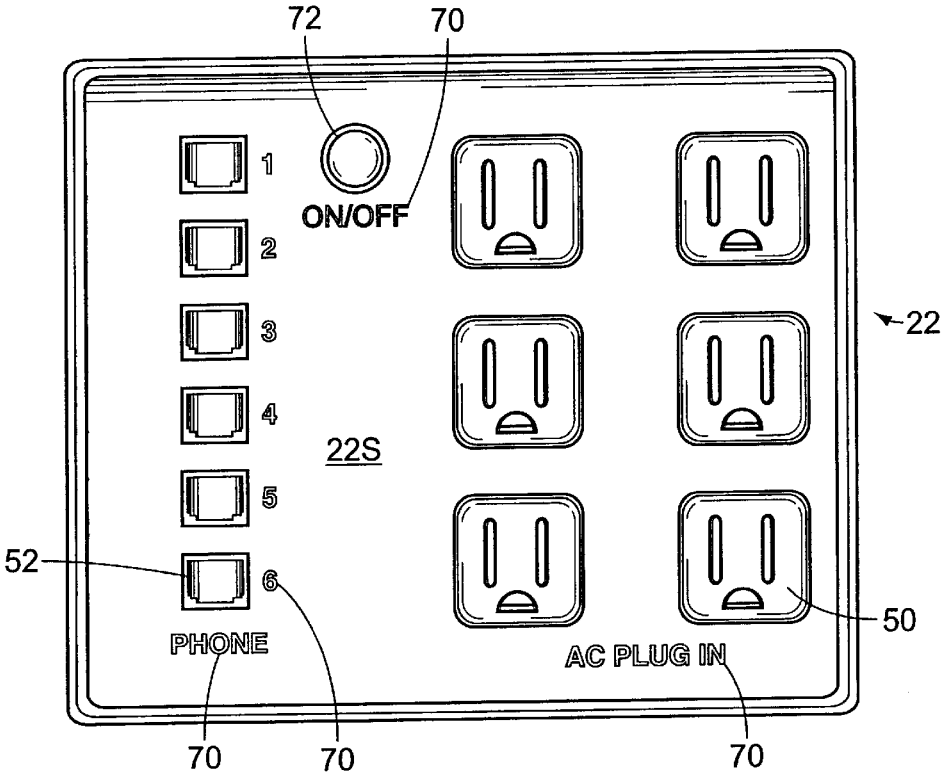
FIG. 2 is a front elevational view of the electrical panel having a plurality of electrical outlets and telephone hookups.

FIG. 2 illustrates the electrical panel 22 having a front surface 22S and having a plurality of electrical outlets 50, a plurality of telephone hookups 52, and an on/off switch 72 for selectively powering the electrical panel 22 and for connecting the phone hookups to phone lines, located upon the front surface 22S. The electrical panel 22 has indicia 70 which label the electrical outlets 50 with the words "AC PLUG IN", which label the telephone hookups 52 with the word "PHONE", and which label the on/off switch 72. Additionally, the indicia 70 identifies the number of each telephone hookup 52 with a numeral.

In use, a user first positions the cart 10 at a location which is convenient for the user and which has an accessible alternating current wall outlet into which the electrical cord 82 which powers the electrical outlets 50 of the electrical panel 22 may be plugged. Additionally, the cart 10 should be positioned at a location which has an accessible wall telephone outlet for connecting the phone cable 21 for connecting the telephone hookups 52 on the electrical panel 22 to phone lines. The phone cable 21 terminates in a connector suitable for attachment to a wall telephone adapter. The cart 10 is rolled to the desired location on its casters 26. Once at the desired location, the user may remove the casters 26 to immobilize the cart 10. The user then places a briefcase 56 or other carrying case upon the top surface 54T of the base 54 by extending the briefcase 56 between the proximal portion 12P of the first side panel 12 and the proximal portion 14P of the second side panel 14 toward the distal side of the base 54. Alternatively, the user may position a briefcase 56 upon the top surface 54T of the base 54 by lowering or raising the briefcase 56 between the proximal portion 12P of the top 12T of the first side panel 12 and the proximal portion 14P of the top 14T of the second side panel 14. The briefcase 56 has a top 56T which may be opened, thereby allowing easy access to its contents which may include compact disks, floppy disks, and other computer accessories. The user then determines which of the various aspects of the cart 10 will be utilized. By way of example, a laptop computer 34 may be positioned upon the top surface 40T of the pedestal 40. Alternatively, a monitor of a personal computer may be placed upon the top surface 40T of the pedestal 40, a keyboard may be placed upon the horizontal table portion 20, and a hard drive may be placed upon the top surface 54T of the base 54 of the cart 10. The computer 34 or other devices may be powered by plugging an electrical cord extending from the device into one of the electrical outlets 50 located on the front surface 22S of the electrical panel 22. A variety of other objects, such as a hand-held computer 56, may be positioned upon the top surface 20T of the horizontal table portion 20. Furthermore, telephones may be plugged into the telephone hookups 52 located on the front surface 22S of the electrical panel 22. These telephone hookups 52 may also be the point of attachment of a computer modem, thereby allowing a user to access the internet. Furthermore, the electrical outlets 50 may be utilized to recharge the batteries of a variety of electrical devices, such as laptop computers or cell phones which are capable of being recharged by an alternating current source.

In conclusion, herein is presented a portable computer cart with electrical outlets, telephone hookups, and a storage area for a briefcase. The invention is illustrated by example in the drawing figures, and throughout the written description. It should be understood that numerous variations are possible, while adhering to the inventive concept. Such variations are contemplated as being a part of the present invention.

What is claimed is:

1. A portable computer cart for supporting a computer, for use in conjunction with telephone lines and a wall outlet, comprising:

a base having a top surface, a bottom surface, and at least one side;

at least one side panel extending vertically upward from the top surface of the base, having a top portion, a bottom portion, an inside surface oriented toward the interior of the cart, and an outside surface oriented toward the exterior of the cart, wherein the bottom portion of the side panel is attached to the top surface of the base;

a horizontal table portion having a top surface and a bottom surface, wherein the bottom surface of the table portion is supported upon and attached to the top portion of the side panel;

a support pole having a first end and a second end, wherein the first end is attached to and extends vertically upward from the top surface of the horizontal table portion;

a pedestal having a pedestal bottom surface which rests upon and is attached to the second end of the support pole, and having a pedestal top surface whereupon a computer may be positioned while the cart is being deployed;

an electrical panel located on the outside surface of the at least one side panel having at least one electrical outlet for powering and recharging computers and cell phones, at least one telephone hookup for connecting telephones and computer modems, and an on/off switch for selectively powering the at least one electrical outlet and connecting the at least one telephone hookup to a telephone line;

an electrical cord which extends from the electrical panel and which terminates in a plug whereby the electrical panel may be selectively powered when the on/off switch is in the on position, and which may be plugged into a wall outlet which supplies alternating current when the cart is being deployed;

a phone cable which is electrically connected to the telephone hookups of the electrical panel and which extends from the electrical panel before terminating in an adaptor which may be plugged into a wall telephone outlet, for connecting the telephone hookups on the electrical panel; and at least two casters located in proximity to the bottom surface of the base, whereby the cart can be rolled to various positions as desired by the user.

2. A portable computer cart for supporting a computer, for use in conjunction with telephone lines and a wall outlet, comprising:

a rectangular base having a top surface, a bottom surface, four corners, a first lateral side, a second lateral side, a proximal side, and a distal side;

three side panels, namely, a first side panel extending vertically upward from the top surface of the base at the first lateral side of the base, a second side panel extending vertically upward from the top surface of the base at the second lateral side of the base, and a third side panel extending vertically upward from the top portion of the base at the distal side of the base, wherein the first side panel has a proximal portion which is located closer to the proximal side of the base, and a distal portion which is located closer to the distal side of the base, the second side panel has a proximal portion which is located closer to the proximal side of the base and a distal portion which is located closer to the distal side of the base, and wherein each side panel has an inside surface which is oriented toward the interior of the cart and an outside surface which is oriented toward the exterior of the cart, and wherein each of the side panels further has a top portion and a bottom portion;

a horizontal table portion having a top surface and a bottom surface, wherein the bottom surface of the horizontal table portion rests along the entire top portion of the third side panel, but rests only upon the distal portion of the top of the first side panel and the distal portion of the top of the second side panel, and wherein the horizontal table portion does not rest upon the proximal portion of the first side panel and the proximal portion of the second side panel, thereby allowing a user to easily place or remove objects such as a briefcase upon the top surface of the base by lowering or raising the objects between the top of the proximal portion of the first side panel and the top of the proximal portion of the second side panel;

a support pole, having a first end and a second end, wherein the first end is attached to and extends vertically upward from the top surface of the horizontal table portion;

a pedestal having a pedestal bottom surface which rests upon and is attached to the second end of the support pole, and a pedestal top surface whereupon a computer may be positioned while the cart is being deployed;

an electrical panel located on the outside surface of one of the side panels, having a plurality of electrical outlets for powering and recharging a computer or a cell phone, a plurality of telephone hookups for connecting a telephone or a computer modem, and an on/off switch for selectively powering the electrical outlets and the telephone hookups;

an electrical cord extending from the electrical panel and terminating in a plug, whereby the electrical panel may be selectively powered, wherein the electrical cord may be plugged into a wall outlet which supplies alternating current when the cart is being deployed;

a phone cable which is electrically connected to the telephone hookups of the electrical panel and which extends from the electrical panel before terminating in an adaptor which may be plugged into a wall telephone outlet, for connecting the telephone hookups on the electrical panel; and four selectively removable casters located in proximity to the base of the cart, whereby the cart can be rolled to various locations as desired by the user or immobilized at a particular location by removing the casters.

3. The portable computer cart as recited in claim 2, wherein the cart further comprises four legs, each having a top portion and a bottom portion, wherein the top portion of each leg is attached to the bottom surface of the base at each of the four corners of the base, and wherein each caster is attached to the bottom portion of one leg.

* * * * *